US009041296B2

(12) United States Patent
Yianni et al.

(10) Patent No.: US 9,041,296 B2
(45) Date of Patent: May 26, 2015

(54) SYSTEM AND METHOD FOR PHYSICAL ASSOCIATION OF LIGHTING SCENES

(75) Inventors: George Frederic Yianni, Eindhoven (NL); Gerardus Henricus Adrianus Johannes Broeksteeg, Veldhoven (NL); Lorenzo Feri, Eindhoven (NL)

(73) Assignee: Koninklijkle Philips N.V., Eindhoven (NL)

( * ) Notice: Subject to any disclaimer, the term of this patent is extended or adjusted under 35 U.S.C. 154(b) by 78 days.

(21) Appl. No.: 13/513,874

(22) PCT Filed: Dec. 13, 2010

(86) PCT No.: PCT/IB2010/055770

§ 371 (c)(1), (2), (4) Date: Jun. 5, 2012

(87) PCT Pub. No.: WO2011/073881

PCT Pub. Date: Jun. 23, 2011

(65) Prior Publication Data

US 2012/0242231 A1 Sep. 27, 2012

(30) Foreign Application Priority Data

Dec. 15, 2009 (EP) ..... 09179189

(51) Int. Cl.
*H05B 37/02* (2006.01)

(52) U.S. Cl.
CPC ..... *H05B 37/029* (2013.01)

(58) Field of Classification Search
USPC ..... 315/151, 129, 152, 294, 312, 291, 297, 315/307; 362/800; 398/78; 702/150; 250/206.1
See application file for complete search history.

(56) References Cited

U.S. PATENT DOCUMENTS

| | | | | |
|---|---|---|---|---|
| 5,526,245 | A * | 6/1996 | Davis et al. | 362/233 |
| 2008/0290818 | A1 | 11/2008 | Fontijn | |
| 2010/0009761 | A1 * | 1/2010 | Ohta | 463/43 |

FOREIGN PATENT DOCUMENTS

| | | | |
|---|---|---|---|
| JP | 2006269381 | A | 10/2006 |
| JP | 2009017267 | A | 1/2009 |
| JP | 2009087834 | A | 4/2009 |
| WO | 2007119126 | A2 | 10/2007 |
| WO | 2007132382 | A2 | 11/2007 |
| WO | 2008029323 | A1 | 3/2008 |
| WO | 2008032237 | A1 | 3/2008 |
| WO | 2008047281 | A2 | 4/2008 |
| WO | 2008059411 | A1 | 5/2008 |
| WO | 2008146245 | A1 | 12/2008 |
| WO | 2009010926 | A2 | 1/2009 |

* cited by examiner

*Primary Examiner* — Sue A Purvis
*Assistant Examiner* — Jae Kim
(74) *Attorney, Agent, or Firm* — Meenakshy Chakravorty

(57) ABSTRACT

A controller for a lighting arrangement is provided, comprising a detector unit having a field of view and a pointing direction. The controller furthermore includes an interface unit for interfacing with the lighting arrangement, and a processing unit connected to the detector unit and the interface unit. The detector unit is arranged to provide detection data including parameters related to one or more identifiable beacons within the field of view of the detector unit. The processing unit is arranged to associate the detection data with a set of lighting parameters for the lighting arrangement and to control the lighting arrangement via the interface unit in accordance with the set of lighting parameters. Also a method of controlling alighting arrangement is provided.

15 Claims, 1 Drawing Sheet

SYSTEM AND METHOD FOR PHYSICAL ASSOCIATION OF LIGHTING SCENES

FIELD OF THE INVENTION

Figure 1:
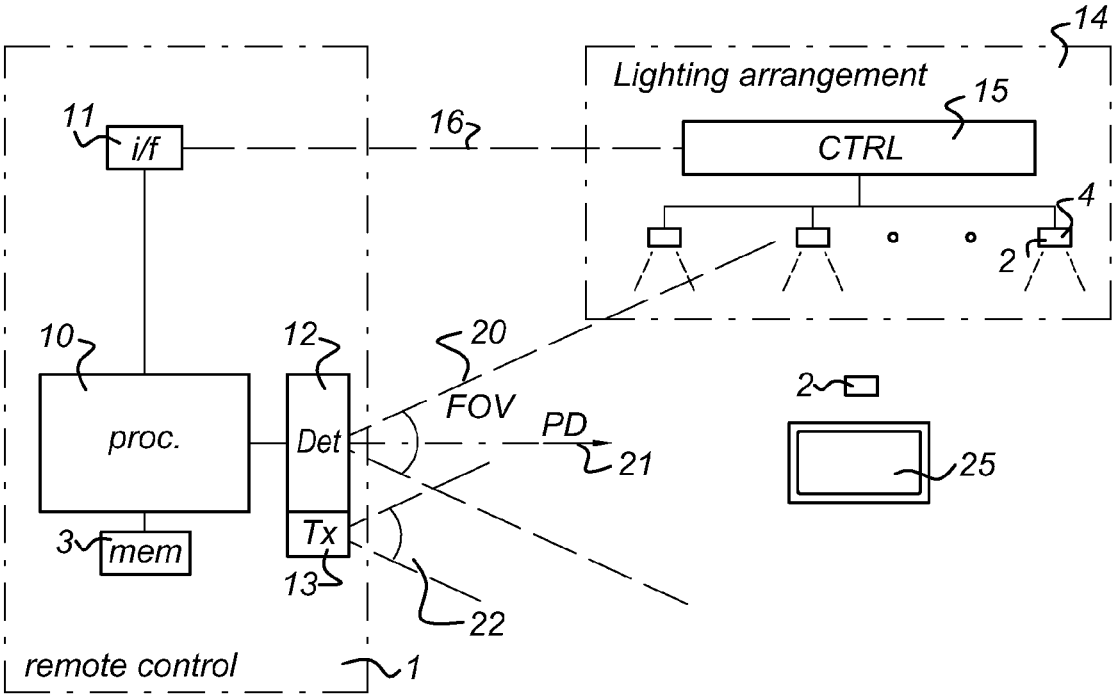

The present invention relates to a controller for a lighting arrangement and to a method of controlling a lighting arrangement.

PRIOR ART

International patent publication WO2008/032237 discloses a system for selecting and controlling light settings. A controllable device, such as a light source or a projector/display, is activated in response to reading data stored on a card, the data including scene data.

SUMMARY OF THE INVENTION

The present invention seeks to provide an improved method and system for controlling lighting scenes in an environment such as a living room.

According to the present invention, a controller for a lighting arrangement is provided, comprising a detector unit having a field of view and a pointing direction, an interface unit for interfacing with the lighting arrangement, and a processing unit connected to the detector unit and the interface unit, the detector unit being arranged to provide detection data comprising parameters related to one or more identifiable beacons within the field of view of the detector unit, and the processing unit being arranged to associate the detection data with a set of lighting parameters for the lighting arrangement. This embodiment allows a user to associate a scene with an object which is associated in turn with the one or more identifiable beacons.

In an embodiment, the detection data comprise the relative (angular) position of each of the one or more identifiable beacons with respect to the pointing direction. This allows associating an 'image' of identifiable beacons surrounding an object with a set of lighting parameters.

In a further embodiment, the one or more identifiable beacons comprise a beacon co-located with a physical object. This allows a user to point the controller at the physical object to associate it with a set of lighting parameters, i.e. a lighting scene.

The one or more identifiable beacons are coded light beacons according to a further embodiment. The code is hidden in the emitted light in a manner invisible to the human eye, and thus provides an invisible source of identification data.

In a yet further embodiment, the one or more identifiable beacons are beacons which are integrated with one or more light sources of the lighting arrangement. The beacons may be an integral part of a light source (e.g. possible when using LED or fluorescent light sources) or may be co-located with a light source (e.g. when the light source is an incandescent light source).

The identifiable beacons may be active beacons, i.e. transmitting an identification code in a continuous manner. As an alternative, the identifiable beacons are passive beacons, in which case the detector unit comprises a transmitter for activating the one or more identifiable beacons. The transmitter field of view can at least cover the field of view of the detector unit to ensure that all beacons within the field of view of the detector unit are activated.

In an embodiment, the processing unit is further arranged to store the detection data and an associated set of lighting parameters. This allows a user to save a scene by pointing at an object or in a certain direction. The scene may be saved using a memory unit, which can be part of the controller, which is either one of the other elements used in the lighting arrangement or a separate unit.

In a further embodiment, the processing unit is further arranged to retrieve a set of lighting parameters associated with the detection data, and control the interface unit to transmit the retrieved set of lighting parameters to the lighting arrangement. This allows the user to recall a scene which has been stored earlier, by simply pointing at the object or in the direction used to store that set of lighting parameters.

In a still further embodiment, the processing unit is arranged to retrieve one set of lighting parameters from a plurality of sets of lighting parameters most closely associated with the detection data. This allows a scene to be recalled using a most likely scene, e.g. in the case when the user is not in exactly the same location as when the scene was saved.

In an even further embodiment, the detection data comprises detection data as a function of time. This embodiment allows associating gestures, using the controller, with a scene, e.g. caused by clockwise or counter-clockwise movement of the pointing direction of the controller. This provides even greater flexibility of the present controller.

In a further aspect, the present invention relates to a lighting system comprising a lighting arrangement for creating a lighting scene, using a set of lighting parameters, and a controller according to any one of the embodiments described above, which is in communication with the lighting arrangement.

In an even further aspect, the present invention relates to a method of controlling a lighting arrangement, comprising associating detection data with a set of lighting parameters for the lighting arrangement, wherein the detection data comprise parameters related to one or more identifiable beacons within a field of view of a detector unit. In a further embodiment, the detection data comprise the relative position of each of the one or more identifiable beacons with respect to a pointing direction of the detector unit. In an even further embodiment, the method further comprises storing the detection data and an associated set of lighting parameters, in order to save scenes. Also, the method may further comprise retrieving a set of lighting parameters associated with the detection data, and transmitting the retrieved set of lighting parameters to the lighting arrangement, in order to retrieve an earlier saved scene.

SHORT DESCRIPTION OF DRAWINGS

Figure 2:
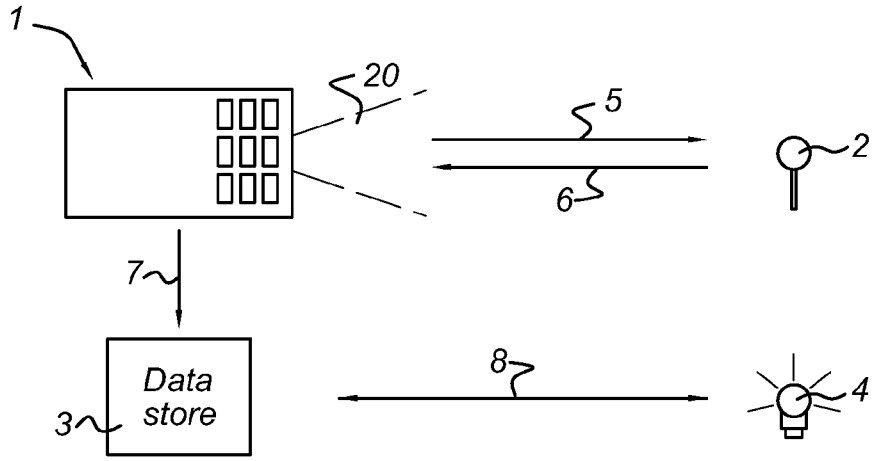

The present invention will be discussed in more detail below, using a number of exemplary embodiments, with reference to the attached drawings, in which FIG. 1 shows a schematic drawing of a lighting system embodying the present invention; and FIG. 2 shows a schematic diagram of parts of the lighting system and the data flow between elements thereof.

DETAILED DESCRIPTION OF EXEMPLARY EMBODIMENTS

The invention can be applied in lighting control systems in homes, shops and office applications. Future lighting applications anticipate a lighting home control system with dimmable lights, color variable lights and wireless control devices like (wall) switches and remote controls. With this system it is possible to create scenes and atmospheres in different rooms for different occasions.

In order to have an intuitive and easy-to-use user interface for a scene-setting system, it is the intention of the embodiments as described below to use a pointing function to identify and select lights or control devices. This identification is needed in order to be able to adjust settings (like hue, saturation, brightness) and in this way create and adjust lighting scenes.

The present embodiments allow the intuitive and easy-to-use pointing interface to also save and recall these lighting scenes. By linking lighting scenes to physical objects the user can make better associations for the scene and thus better remembers them. Said interface also addresses the limitation of having a fixed number of scene buttons on e.g. a remote control.

The present embodiments address the problem of scene buttons being difficult to remember and having no physical relationship to a scene. They also address the problem of there being only a fixed number of scene buttons on a remote control (whilst still offering direct access). Further, they add value for the users by allowing them to personalize the way in which they interact with their lighting system and also allow them to associate scenes with objects or pictures which should increase ease of use.

In FIG. 1 a schematic diagram is shown of a lighting system comprising a lighting arrangement 14 with a plurality of light sources 4 which provide scene lighting under the control of a control unit 15. The light sources 4 may e.g. be controllable lights (LED, fluorescent lighting, incandescent lighting (bulbs), etc., but may also include other types of actuators, e.g. controllable blinds or shutters in front of windows, etc.). The plurality of light sources 4 may be accompanied by an identifiable beacon 2, e.g. as an integrated part of the light source 4, or as an additional part collocated with the light source 4. The lighting arrangement 14 cooperates with a (remote) controller 1, and a communication link 16 is provided, e.g. using infrared or RF communications, to allow data exchange between controller 1 and the lighting arrangement 14.

The controller 1 comprises a processing unit 10, connected to an associated memory 3 and an interface unit 11, which interface unit 11 is able to communicate with the control unit 15 of the lighting arrangement 14. Furthermore, the processing unit 10 is connected to a detector unit 12 having a field of view (FOV) 20 around a pointing direction 21. Optionally, the processing unit 10 is also connected to a transmitting unit 13, having a transmitter field of view 22, which in general overlaps with the detector field of view 20. The controller 1 can e.g. be directed at a physical object, such as a television unit 25 in the embodiment shown, which physical object 25 may optionally be provided with an identifiable beacon 2.

The detector unit 12 is arranged to provide detection data to the processing unit 10, which detection data comprises parameters related to one or more identifiable beacons 2 which are within the field of view 20 of the detector unit 12. The processing unit 10 may then associate the detection data with a set of lighting parameters for the lighting arrangement 14, and transfer this set of lighting parameters to the lighting arrangement 14 (via interface unit 11 and control unit 15).

In an embodiment, the detection data comprises the relative (angular) position of each of the one or more identifiable beacons 2 with respect to the pointing direction 21. For example, according to detection data a first beacon 2 may be 20° to the left of the pointing direction 21 and a second beacon 2 may be 80° above the pointing direction 21.

The controller 1 as described with reference to FIG. 1 may be used to implement the idea of physically associating a scene with an (additional) object in a room. This can be achieved by physically placing a device (identifiable beacon) in or near the physical object 25 and detecting this identifiable beacon 2 as being close to the pointing direction 21. The identifiable beacon 2 is in this case co-located with a physical object 25.

Alternatively, implementation may be accomplished by 'recognizing' the image of one or more identifiable beacons 2, and associating this with the object the controller 1 is pointing at (the processing unit actually associating the detected one or more identifiable beacons 2 with a specific set of lighting parameters).

The identifiable beacons 2 are e.g. coded light beacons, which convey a code in the emitted light, which code is invisible to the human eye. In this embodiment, the identifiable beacon 2 may be integrated with, and is part of, a light source 4. As an alternative, an identifiable beacon 2 is co-located with a light source 4, e.g. in the case that the light source is not suitable for integration with a coded light, such as incandescent bulbs.

The identifiable beacon 2 may be an active beacon, which continuously emits the (hidden) code, or alternatively, a passive beacon. Such a passive beacon 2 can be activated to transmit the code by a signal from the transmitting unit 13, e.g. using (infrared) light, RF or other types of radiation. This embodiment may also be applied for selecting an object 25 to be controlled, which cannot generate its own coded light. For example a remotely controllable bulb 4 which was not prepared for coded light generation could have a beacon 2 attached to it to give it the coded light functionality, or use could be made of a finger printing method as is explained below.

The controller 1 as described above can be used to select an object 25, i.e. by pointing the controller 1 such that the pointing direction 21 is aimed at the physical object 25. A remote control type of apparatus can be used as controller 1, which can receive user interactions such as one or more button pushes to select an object 25. For example, the user can "Select" the object 25 by pointing to it and pressing a "Select button". The selection is then performed by detecting a coded light beacon 2 on (or near) the object 25, or by detecting coded light beacons 2 around the object 25.

The physical object 25 could be any object in the room which a user associates with a scene. For example, the fireplace is a cozy scene, and the TV represents a TV watching scene. The general idea is that by allowing the user to associate scenes with a familiar object 25 they will more easily remember them even if they have many scenes.

A button (as part of the controller 1) is defined as any interface with an "on" and "off" state, including mechanical push buttons, touch areas, sliders and switches.

An embodiment of the present invention is a use case where the user sets the light sources 4 of the lighting arrangement 14 to a scene they would like to save. Then the user "selects" an object 25 in the room, after which he performs some sequence of button presses (or the selection itself is the trigger) on the controller 1, and the scene is now saved to this object 25. In this case, the processing unit 10 is in fact arranged to store the detection data and the associated set of lighting parameters.

If, at a later time, the user selects the same object 25 and performs a different sequence of button presses (or the selection itself is the trigger) the scene will be recalled, i.e. the processing unit 10 is arranged to retrieve a set of lighting parameters associated with the detection data, and to control the interface unit 11 to transmit the retrieved set of lighting parameters to the lighting arrangement 14.

A further alternative embodiment relates to where the processing unit 10 is arranged to retrieve one set of lighting parameters from a plurality of sets of lighting parameters most closely associated with the detection data. This would allow small changes in the detection data, e.g. when a position of the controller 1 for recall of a scene is slightly different from the position of the controller 1 when saving a scene.

An example of use is given in the next paragraph:

The user creates a cosy scene which she associates with her fireplace. The user places a beacon 2 on the fireplace 25. The user then selects the fireplace by pointing the controller 1 and presses the save scene button combination. At a later time the user selects the fireplace again and now presses the recall scene button combination. The scene associated with the fireplace is now restored.

In a refinement to the previous embodiment, a physical beacon 2 is placed in the object 25 and provides the necessary pointing functionality (e.g. coded light code). When the user selects this object 25, actually this beacon 2 is detected and then a scene is saved for this object or a scene is recalled from this object. In this embodiment, as the scenes are saved on separate devices there is no need for a limit on the number of scenes.

In an alternative embodiment, there is no physical device associated with the object 25 on which the scene is saved. Instead, when the save action is performed the controller 1 records defining features in its field of view 20 (as an image or in relation to beacons 2) and these defining features together with the scene are stored locally, e.g. using memory unit 3 in the controller 1. The next time the user points at this object 25, the controller 1 will compare its field of view with recorded ones and identify that it is pointing at a saved location, so that object 25 can be selected and an associated scene recalled from it.

In a further embodiment, the proposed detector unit 12 (photo detector) has three or more "eyes" by means of which the detector unit 12 can determine parameters of all coded light beacons 2 in its field of view 20. An embodiment with three eyes gives an x, y offset, an embodiment with four eyes gives a radial width as well, and an embodiment with five eyes gives x, y widths and an even better precision. This provides a unique fingerprint for a location (i.e. where the controller is spatially located) which can be used to save a scene. In the user's perception the scene is saved to an object 25 (e.g. fireplace) but in reality it is saved to the collection of coded light beacons surrounding this object 25.

In an alternative embodiment, the detection data comprises detection data as a function of time. Using this embodiment, it is possible that gestures, possibly in combination with objects 25, are associated with the scene which is saved. In this embodiment, it is possible to associate detection data as a function of time with a set of lighting parameters. For example, two different scenes are associated with a clockwise and counter-clockwise circling around the TV.

The memory unit 3 in which the associations between detection data and a set of lighting parameters (and possibly also objects 25) are stored, may, as discussed above, be part of the controller 1. As an alternative, the memory unit 3 is part of the identifiable beacon 2, and the associated data for implementation of this embodiment is communicated to the identifiable beacon 2. As a further alternative, the memory unit 3 may be part of the lighting arrangement 14, e.g. in communication with the control unit 15. As an even further alternative, the memory unit 3 is part of the physical object 25.

In a further refinement to this, the object can display some information about each scene, perhaps in the form of pictures which have some relationship to the scene.

In an additional embodiment, an automatic sensing unit (e.g. a presence sensor) is linked during commissioning of the system to a beacon 2. For example, in the embodiment shown in FIG. 2, one of the light sources 4 is in fact a sensing unit. Scenes can then be saved as associated to the beacon or beacons 2 as in prior embodiments. However, when the automatic sensing unit 4 is triggered it can trigger the scene associated with the beacon 2 to be triggered either directly to the data store (memory unit 3) or via the beacon 2 or via the (remote) controller 1. A user can then associate a triggered event (which the sensing unit monitors) to a natural object 25. E.g., a welcome home scene is saved to a beacon 2 on the door which is recalled by a presence sensor 4 on the ceiling.

In FIG. 2 a further embodiment is shown schematically including data flow between various elements. In this embodiment, an identifiable beacon 2 is sensed by a (remote) controller 1 when it is in the field of view 20 of the controller 1.

The (remote) controller 1 is the device which triggers the scene "save" or the scene "recall". It is most likely some form of user interface that can communicate to the data store (memory unit 3) and communicate with or read (identify) the beacon 2. The controller 1 is also the device that "selects" a beacon 2 (or object 25 associated with the beacon(s) 2).

The beacon 2 is a device placed on the object 25, identifying it to the controller 1. The object can be a physical object 25, the surroundings of the device (in the case of looking at surrounding beacons 2) or the location of the device in the case of mapping solutions. There are two types of beacons 2 as described above: active beacons 2, which require the controller 1 to request information about them using channel 5, and passive beacons 2, which are just read using channel 6 and do not have a channel 5.

Data store or memory unit 3 is the device which holds all the scene data for the present system/method. That is to say, it holds the states of all actuators 4 for a specific scene; it also holds the relationship between the specific scene and the identification of the beacon 2. The data store 3 could be a separate device (communicating with the controller 1 using channel 7), or it could be integrated in the controller 1, or integrated in the beacons 2, or integrated in the actuators 4. Note that if the data store 3 is integrated in the actuators 4 the scene data could be distributed across all actuators 4 (as each actuator 4 only needs to know its own settings for a given scene).

The actuators 4 are the objects which have a specific state associated with each scene. They are most commonly light sources 4, but could also be window blinds, consumer electronics devices or other controllable objects.

The actuator channel 8 is used by the data store 3 to instruct actuators 4 to recall scenes or to request the current state for saving scenes. In the case that the data store 3 is in the actuators 4, recall means recall the stored setting (set of lighting parameters) for a scene and saving means save the current setting (set of lighting parameters) to a scene. For other data store locations, recall means pushing out states to all actuators 4 and saving means requesting and saving states for all actuators 4.

The present invention has been described above using detailed descriptions of embodiments, with reference to the attached drawings. In these embodiments, elements may be replaced by equivalent elements providing a similar functionality. The scope of the invention is determined by the language of the claims as attached and its equivalents. The reference signs used refer to the embodiments described above and are not intended to limit the scope of the claims in any manner.

The invention claimed is:

1. A controller for a lighting arrangement to associate a lighting scene with an object and co-located beacons, comprising:

a detector unit in a remote control having a field of view and a pointing direction, an interface unit in the remote control configured to interface with the lighting arrangement, and a processing unit in the remote control connected to the detector unit and the interface unit, the detector unit configured to provide detection data including parameters related to one or more identifiable co-located beacons within the field of view of the detector unit, wherein the one or more identifiable co-located beacons are configured to provide a multi-axis offset for the pointing direction of the remote control so that a spatial location provides a unique fingerprint location, the remote control configured to operate to spatially locate the one or more identifiable co-located beacons and store and recall the unique fingerprint location and pointing direction;

the processing unit configured to associate the unique fingerprint location and detection data associated with the beacons with a set of lighting parameters for the lighting arrangement, the remote control configured to communicate with a control unit of the lighting arrangement.

2. A controller according to claim 1, wherein the detection data comprise the relative position of each of the one or more identifiable beacons with respect to the pointing direction.

3. A controller according to claim 1, wherein the one or more identifiable beacons comprise a beacon co-located with the physical object.

4. A controller according to claim 1, wherein the one or more identifiable beacons are coded light beacons.

5. A controller according to claim 1, wherein the one or more identifiable beacons are beacons which are integrated with one or more light sources of the lighting arrangement.

6. A controller according to claim 1, wherein the detector unit comprises a transmitter for activating the one or more identifiable beacons.

7. A controller according to claim 1, wherein the processing unit is further arranged to store the detection data and an associated set of lighting parameters.

8. A controller according to claim 1, wherein the processing unit is further arranged to retrieve a set of lighting parameters associated with the detection data, and control the interface unit to transmit the retrieved set of lighting parameters to the lighting arrangement.

9. A controller according to claim 8, wherein the processing unit is further arranged to retrieve one set of lighting parameters from a plurality of sets of lighting parameters most closely associated with the detection data.

10. A controller according to claim 1, wherein the detection data comprises detection data as a function of time.

11. A method of controlling a lighting arrangement by associating a lighting scene with an object and co-located beacons, comprising:

associating a beacon with an object, a detector unit in a remote control having a field of view and a pointing direction receiving detection data from the beacon, an interface unit in the remote control communicating by the remote control with a control unit of the lighting arrangement, associating by the remote control the detection data with a set of lighting parameters of the lighting arrangement, wherein the detection data includes parameters related to one or more identifiable co-located beacons within a field of view of the detector unit, and wherein the one or more identifiable co-located beacons provide a multi-axis offset of the remote control so that a spatial location provides a unique fingerprint location, the remote control operating to spatially locate the one or more identifiable co-located beacons and store and recall the unique fingerprint location;

a processing unit in the remote control connected to the detector unit and the interface unit associating the unique fingerprint location and detection data associated with the beacons with a set of lighting parameters for the lighting arrangement, the remote control operating to communicate with the control unit of the lighting arrangement.

12. Method according to claim 11, wherein the detection data comprise the relative position of each of the one or more identifiable beacons with respect to a pointing direction of the detector unit.

13. Method according to claim 11, further comprising storing the detection data and an associated set of lighting parameters.

14. Method according to claim 11, further comprising retrieving a set of lighting parameters associated with the detection data, and transmitting the retrieved set of lighting parameters to the lighting arrangement.

15. A remote control for a lighting arrangement which associates a lighting scene with an object co-located with a beacon, comprising:

a detector unit in a remote control having a field of view and a pointing direction;

an interface unit in the remote control configured to interface with a control unit of a lighting arrangement;

a processing unit in the remote control connected with the detector unit and the interface unit;

the detector unit configured to provide detection data including parameters related to one or more identifiable co-located beacons within the field of view of the detector unit;

the one or more identifiable co-located beacons configured to emit a coded light signal detectable by the detector unit;

the processing unit configured to associate the detection data associated with the beacons with a set of lighting parameters for the lighting arrangement;

wherein the one or more identifiable co-located beacons are configured to provide a multi-axis offset determined by the pointing direction of the remote control so that a spatial location of the remote control provides a unique fingerprint location, the remote control configured to spatially locate the one or more identifiable co-located beacons and store and recall unique fingerprint location and pointing direction; and the processing unit configured to associate the unique fingerprint location and detection data associated with the beacons with a set of lighting parameters for the lighting arrangement, the remote control configured to communicate with a control unit of the lighting arrangement.

* * * * *